US006557736B1

(12) United States Patent
Ophardt

(10) Patent No.: US 6,557,736 B1
(45) Date of Patent: May 6, 2003

(54) PIVOTING PISTON HEAD FOR PUMP

(76) Inventor: Heiner Ophardt, 3931 Vineland Crescent, Vineland Ontario (CA), L0R 2C0

( * ) Notice: Subject to any disclaimer, the term of this patent is extended or adjusted under 35 U.S.C. 154(b) by 0 days.

(21) Appl. No.: 10/050,905

(22) Filed: Jan. 18, 2002

(51) Int. Cl.[7] ..... B67D 5/06
(52) U.S. Cl. ..... 222/321.9; 222/321.7
(58) Field of Search ..... 222/321.1, 321.6, 222/321.7, 321.9, 378, 383.1, 385

(56) References Cited

U.S. PATENT DOCUMENTS 5,165,577 A 11/1992 Ophardt
5,282,552 A 2/1994 Ophardt
5,373,970 A * 12/1994 Ophardt ..... 222/321.8
5,431,309 A * 7/1995 Ophardt ..... 222/321.7
5,489,044 A 2/1996 Ophardt
5,638,989 A * 6/1997 Ophardt et al. ..... 222/105
5,676,277 A 10/1997 Ophardt
5,975,360 A 11/1999 Ophardt
6,343,724 B1 2/2002 Ophardt et al.
6,409,050 B1 * 6/2002 Ophardt et al. ..... 222/181.1

FOREIGN PATENT DOCUMENTS

EP 650687 A1 * 5/1995 ..... A47K/05/06

* cited by examiner

*Primary Examiner*—Kenneth Bomberg
(74) *Attorney, Agent, or Firm*—Riches, McKenzie & Herbert LLP

(57) ABSTRACT

A piston for a pump in which on the piston being moved in one direction, a disc tilts out of a coaxial sealed orientation with the chamber to assist in permitting fluid flow therepast, preferably, the disc tilts by reason of the stem of the piston being deflectable on the piston being moved in the one direction.

18 Claims, 11 Drawing Sheets

PIVOTING PISTON HEAD FOR PUMP

SCOPE OF THE INVENTION

This invention relates generally to a piston for a pump and, more particularly, to an arrangement for a disposable plastic pump for dispensing flowable material.

BACKGROUND OF THE INVENTION

Pump assemblies for fluid dispensers are well known. Such pump dispenser includes those invented by the inventor of this present application including those disclosed in U.S. Pat. No. 5,165,577, issued Nov. 24, 1992; U.S. Pat. No. 5,282,552, issued Feb. 6, 1996; U.S. Pat. No. 5,676,277, issued Oct. 14, 1997 and U.S. Pat. No. 5,975,360, issued Nov. 2, 1999, the disclosures of which are incorporated herein by reference.

These fluid dispensers share a common characteristic that a piston is axially slidable in a chamber with the piston carrying a flexing disc which disc is adapted to deflect away from the chamber walls on movement of the piston in one direction in the chamber. The present inventor has appreciated that a disadvantage with such known piston pumps is that the force required to move the piston in a direction to deflect the flexing disc and permit fluid to move past the flexing disc can be substantial and may exceed standards set to accommodate handicapped persons. The forces required to move the piston can significantly increase with increased viscosity of the fluid.

The present inventor has appreciated that a further disadvantage with such known piston pumps is that difficulties are encountered when pumping fluids containing particulate matter. Hand soaps are known which include solid particles such as pumice, sand and other solid particulate matter mixed with liquids to provide a slurry-like composition which is fluid. The solid particles may or may not be held in suspension and, typically, the solid particles are not in suspension, however, the mixture has sufficiently great solids that the liquid merely fills spaces between the particles and the slurry has a relatively thick paste-like consistency.

In the use of known pumps with the piston carrying a flexible disc, the liquid in the mixture has been found to selectively flow past the disc with the disc restricting flow of the solid particles therepast. Therefore, due to limited deflection of the disc, the liquid comes to be removed and a matrix of solid particles with liquid removed develops upstream of the disc forming a plug which restricts further flow.

SUMMARY OF THE INVENTION

To at least partially overcome these disadvantages, the present invention provides a piston for a pump in which on the piston being moved in one direction, a disc tilts out of a coaxial sealed orientation with the chamber to assist in permitting fluid flow therepast, preferably, the disc tilts by reason of the stem of the piston being deflectable on the piston being moved in the one direction.

An object of the present invention is to provide a nozzle for a fluid pump which facilitates dispensing viscous fluids such as relatively thick hand soaps, honey, ketchup, mustard and other fluids with a high viscosity and other flowable mixtures such as slurries and pastes incorporating solid particles.

Another object is to provide a pump adapted to dispense flowable materials consisting of dry particular matter and dry flowable powders.

Another object is to provide a piston for a pump assembly which piston is adapted to dispense viscous fluids and may be formed as a unitary piece of plastic for ease of disposal.

Accordingly, in one aspect, the present invention provides a pump for dispensing fluids comprising:

- a piston-chamber forming member having a cylindrical chamber about a chamber axis, the chamber having a cylindrical axially extending chamber wall,
- a piston forming element received in the piston-chamber forming member axially slidable inwardly and outwardly therein;
- said piston forming element having a head disc and a base,
- the head disc disposed coaxially about a disc axis and extending radially outwardly to a sealing edge portion circumferentially thereabout,
- the head disc coupled to the base for tilting of the head disc between a first coaxial sealed orientation and a second tilted unsealed orientation,
- in the first sealed orientation, the head disc is orientated with its axis coaxial the chamber axis and the sealing edge portions engaging the chamber wall to prevent fluid flow therepast in a first direction,
- in the second unsealed orientation, the head disc is orientated with its axis at an angle relative the chamber axis and the sealing edge portions permitting fluid flow therepast in a second direction opposite to the first direction.

BRIEF DESCRIPTION OF THE DRAWINGS

Further aspects and advantages of the present invention will become apparent from the following description taken together with the accompanying drawings in which.

DETAILED DESCRIPTION OF THE DRAWINGS

Figure 1:
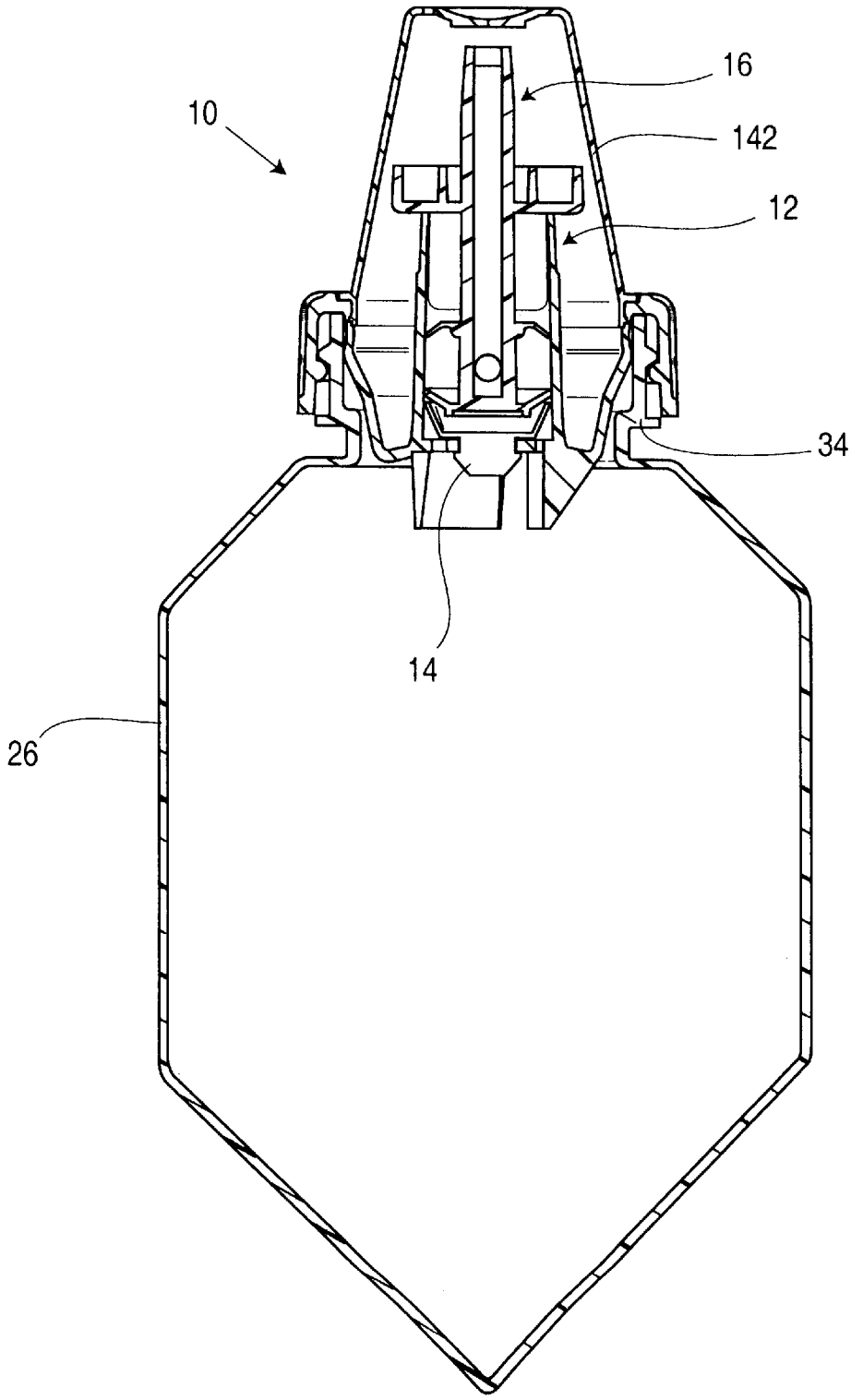
Figure 1 (Prior Art)
FIG. 1 is a cross-sectional side view of a prior art three-piece pump of the type disclosed in U.S. Pat. No. 5,676,277.
Figure 2:
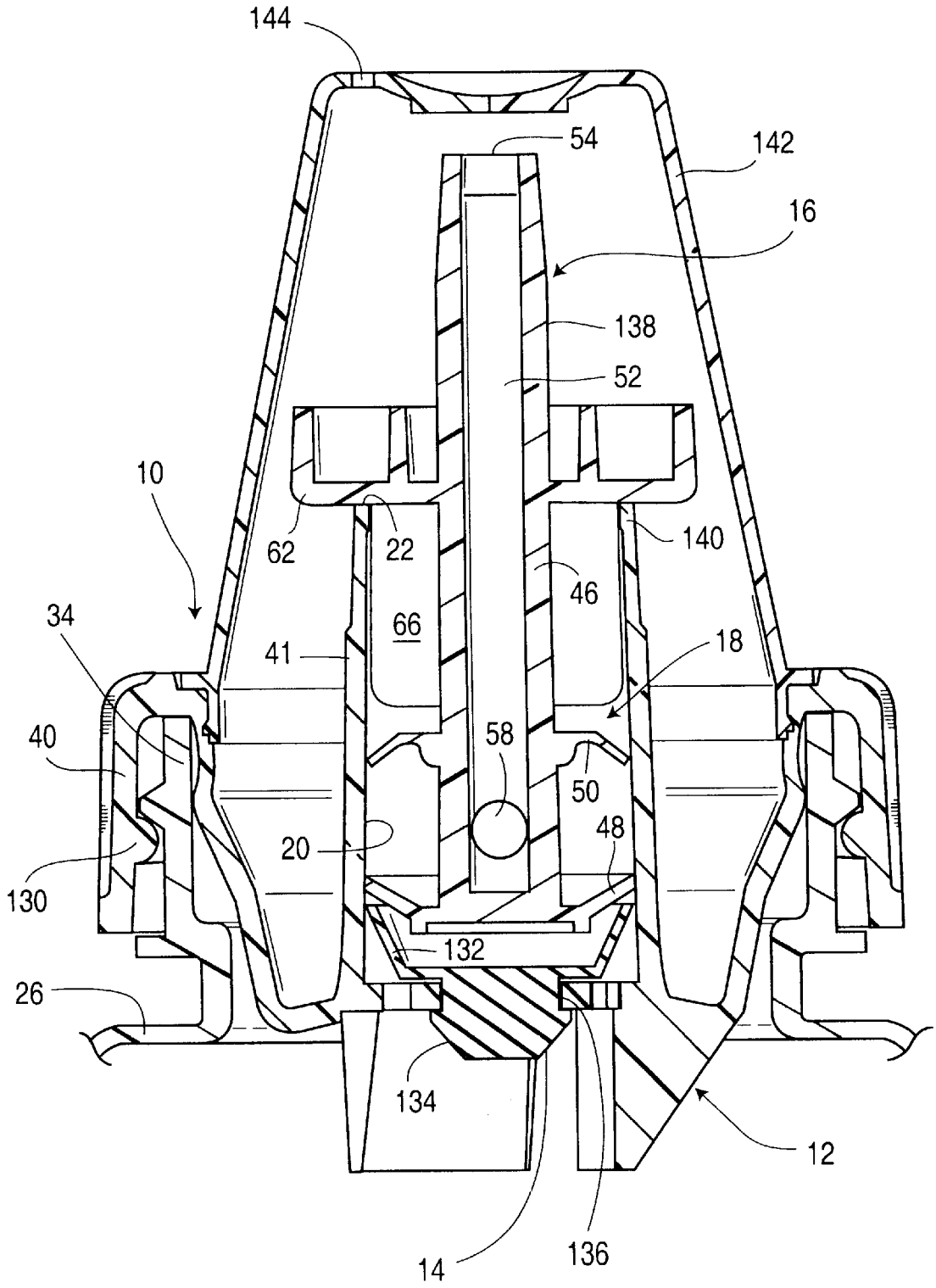
Figure 2 (Prior Art)
FIG. 2 is an enlarged view of the prior art pump assembly shown in FIG. 2.

Reference is made first to a prior art device shown in FIGS. 1 and 2 and comprising a pump assembly 10 secured to a collapsible plastic container 26 having a threaded neck 34. The pump assembly has a body 12, a one-way valve 14 and a piston 16.

The body 12 provides a cylindrical chamber 18 in which the piston 16 is axially slidable between a retracted and an extended position so as to draw fluid from within the container 26 and dispense it out of the outlet 54.

The piston 16 has a stem 46 carrying a flexing head disc 48, a sealing base disc 50 and locating webs 66. The stem 46 comprises a tubular member and can be seen to have a passage 52, the outlet 54 and an inlet 58. The inlet 58 is disposed between the head disc 48 and the base disc 50.

The one-way valve 14 comprises a unitary piece of resilient material having a resilient, flexible, annular rim 132 for engagement with the side wall of the chamber 18. The one-way valve is integrally formed with a shouldering button 134 which is secured in a snap-fit inside an opening 136 in a central bottom of the chamber 18.

An engagement flange 62 is provided on the stem 46 for engagement to move the piston 16 inwardly and outwardly. The engagement flange also serves the function of a stopping disc to limit axial inward movement of the piston 16 by engagement with the outer end 22 of the body 12. The stem 46 is shown to extend outwardly from the engagement flange 62 as a relatively narrow tube 138.

The body 12 carries an outer cylindrical portion 40 carrying threads 130 to cooperate with threads formed on the threaded neck 34 of the container 26. A removable cover 142 fits in a snap engagement onto body 12. In both FIGS. 1 and 2, the pump assembly is shown in a storage position inverted prior to use. For use, the cover 142 is removed and the pump is preferably inverted such that the outlet 54 is directed downwardly.

Piston 16 is generally cylindrical in cross-section and adapted to be slidably received in chamber 18. The piston 16 is a unitary element formed entirely of plastic preferably by injection molding. Piston 16 has the central hollow stem 46 extending along the central longitudinal axis of the piston 16. The head disc 48 is a circular resilient flexible disc located at the inwardmost end of the piston 16 and extending radially therefrom. The head disc 48 is sized to circumferentially abut a cylindrical inner chamber wall 20 substantially preventing fluid flow therepast when the piston 16 is moved outwardly from the chamber. The head disc 48 is formed as a thin resilient disc, in effect, having an elastically deformable edge portion to engage the chamber wall 20. The edge portion extends radially outwardly and in a direction axially outwardly of the chamber 18.

The base disc 50 is also shown as a circular resilient flexible disc located on the stem 46 spaced axially outwardly from the head disc 48. The base disc 50 extends radially outwardly from the stem 46 to circumferentially engage the chamber wall 20 substantially preventing fluid flow therebetween on at least movement of the piston inwardly into the chamber. As with the head disc 48, the base disc 50 is formed as thin resilient disc, in effect, having an elastically deformable edge portion to engage the chamber wall 20.

Piston stem 46 has a central hollow passage 52 extending along the axis of the piston 16 from a blind inner end located in the stem 46 between the head disc 48 and the base disc 50, to an outlet 54 at the outer end of the piston 16. A channel 56 passes from the inlets 58 located on either side of the stem 46 between the head disc 48 and the base disc 50, radially inwardly through the piston 16 to communicate with central passage 52. The channel 56 and central passage 52 permit fluid communication through the piston 16, past the base disc 50, between the inlets 58 and the outlet 54.

Axially extending webs 66 are provided to extend radially from stem 46. These webs 66 engage chamber wall 20 so as to assist in maintaining the piston 16 axially centered within the chamber 18 when sliding in and out of the chamber 18.

During a withdrawal stroke in which the piston 16 is moved outwardly from the chamber 18, the withdrawal of the piston causes the one-way valve 14 to open with fluid to flow into the chamber 18 past annular rim 132 which is deflected radially inwardly. In the withdrawal stroke, head disc 48 remains substantially undeflected and assists in creating suction forces in chamber 18 to deflect rim 132 and draw fluid into chamber 18 past rim 132.

During a return stroke in which the piston 16 is moved inwardly into the chamber, the return of piston 16 with flow prevented outwardly past the sealing disc 50 pressurizes fluid in chamber 18 between the head disc 48 and the one-way valve 14. This pressure urges rim 138 radially outwardly to a closed position abutting the chamber wall. As a result of this pressure, head disc 48 deflects at its periphery so as to come out of sealing engagement with the chamber walls 20 and permit fluid to flow outwardly past head disc 48 into the annular space between the head disc 48 and the sealing disc 50 and hence out of chamber 18 via inlets 58, channel 56 and passage 52.

The head disc 48 needs, on one hand, to substantially prevent flow therepast in the withdrawal stroke and, on the other hand, deform to permit flow therepast in the return stroke. The head disc 48 shown facilitates this by being formed as a thin resilient disc, in effect, having an elastically deformable edge portion near chamber wall 20.

When not deformed, head disc 48 abuts chamber wall 20 to form a substantially fluid impermeable seal. When deformed, as by its edge portion being bent away from wall 20, fluid may flow outwardly past the head disc. Head disc 48 is deformed when the pressure differential across it, that is, when the pressure on the upstream side is greater than the pressure on the downstream side by an amount greater than the maximum pressure differential which the edge portions of the disc can withstand without deflecting. When this pressure differential is sufficiently large, the edge portions of the head disc deform and fluid flows outwardly past. When the pressure differential reduces to less than a given pressure differential, the disc returns to its original shape substantially forming a seal with the wall 20.

Reference is made to FIGS. 3 to 8 which show a first embodiment of the present invention and, in particular, a piston 16 in accordance with the present invention to replace the prior art piston 16 shown in prior art FIGS. 1 and 2. In all of the Figures, identical reference numerals are used to refer to the same elements.

Figure 6:
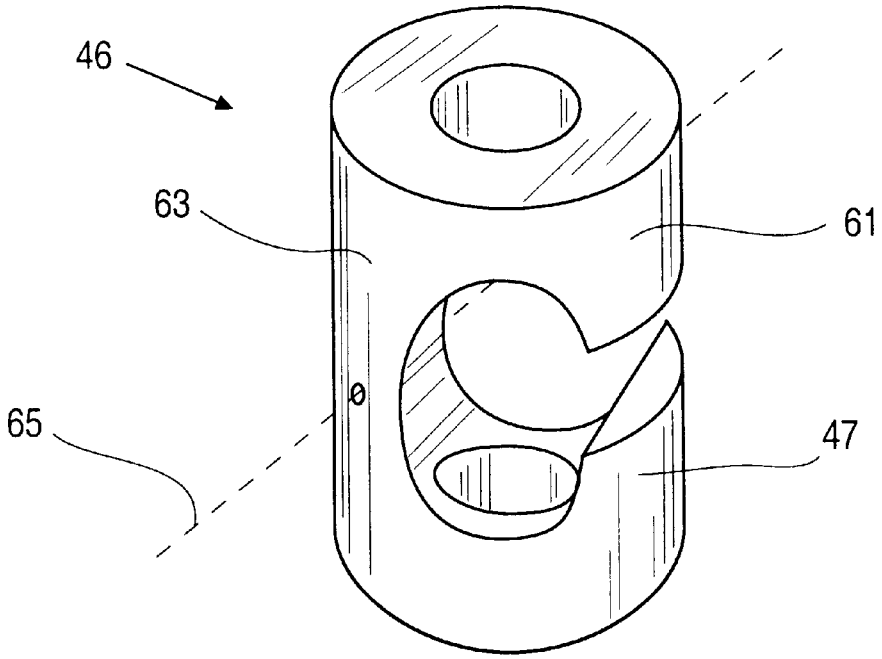
FIG. 6 is a schematic pictorial view showing a segment of the stem of the piston of FIG. 3 indicated by bracket 6 in FIG. 3.
Figure 7:
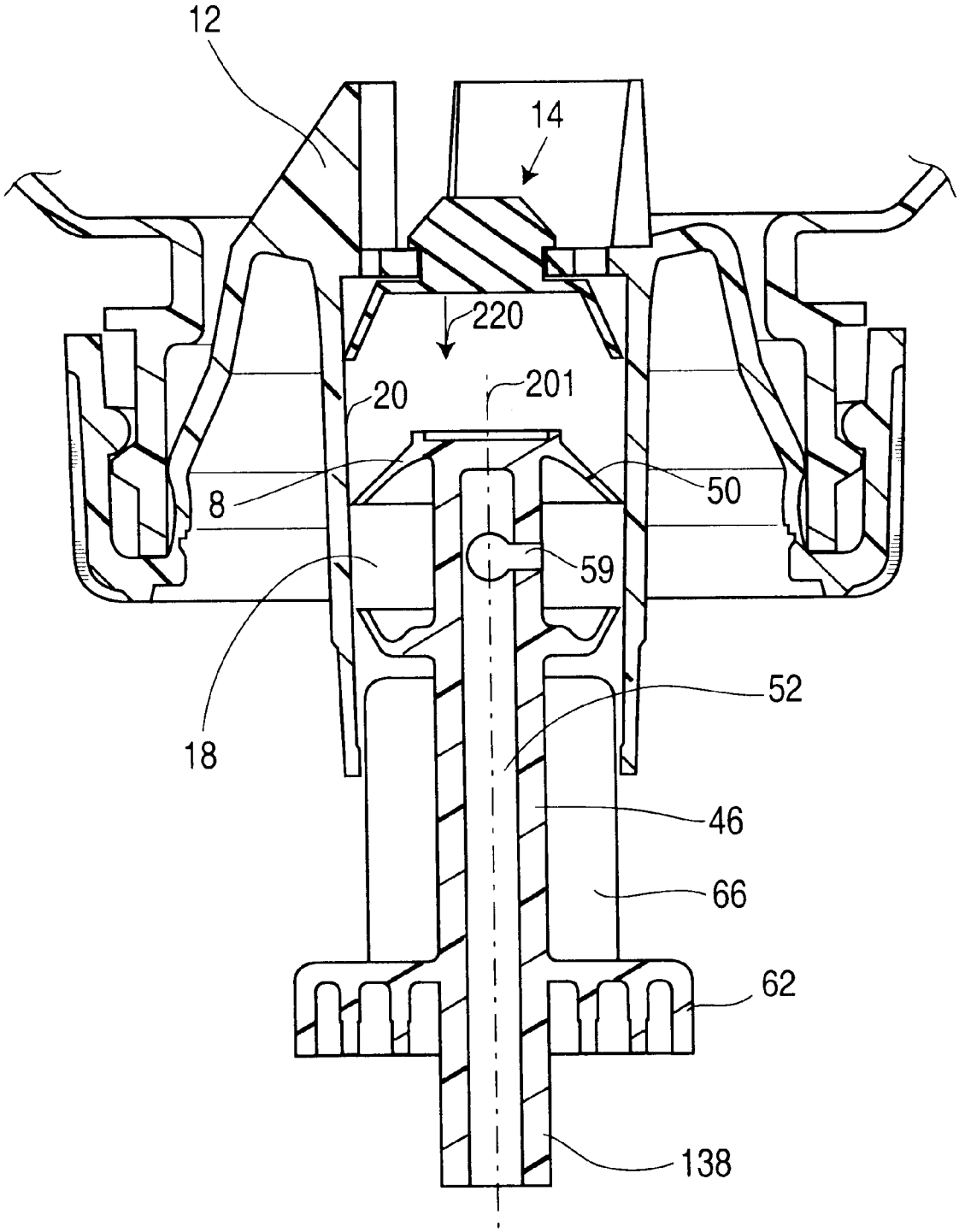
FIG. 7 is a cross-sectional view of a pump with a piston in accordance with FIGS. 3 to 6 with the piston head in a sealed compartment.
Figure 8:
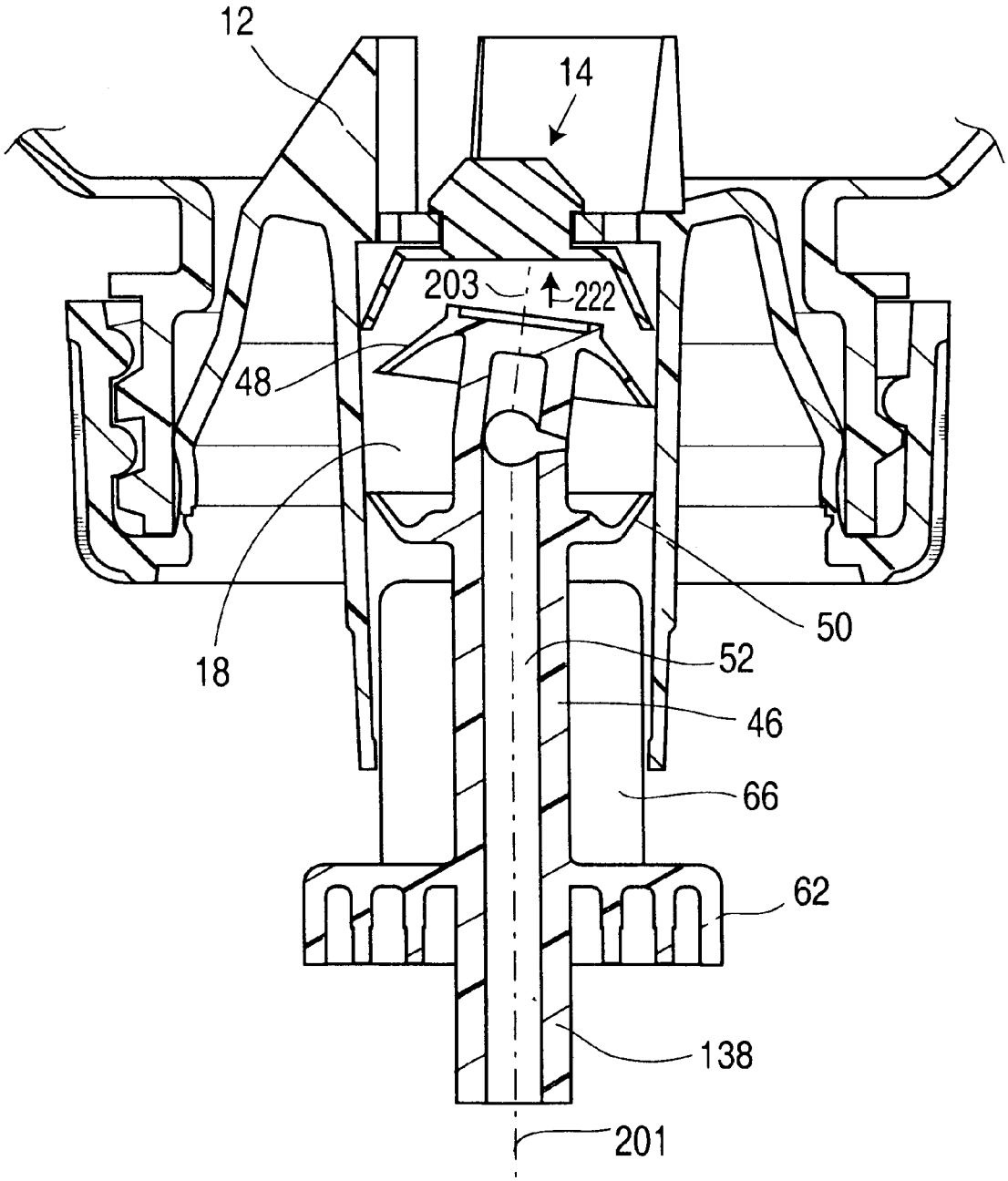
FIG. 8 is a cross-sectional view of the pump of FIG. 7 with the piston head in an unsealed compartment.

In FIGS. 3 to 8, every element of the piston 16 and the piston-chamber forming body 12 are identical to that in FIGS. I and 2 with the sole exception that the stem 46 has a slot 59 cut through the side wall 61 of the stem 46. In a simple sense, cutting away the side wall 61 of the stem 46 provides the stem to be flexible such that the head disc 48 will on movement of the piston inwardly into the chamber assume a tilted orientation as shown in FIG. 8 to facilitate the flow of fluid outwardly past the head disc 48.

Figure 4:
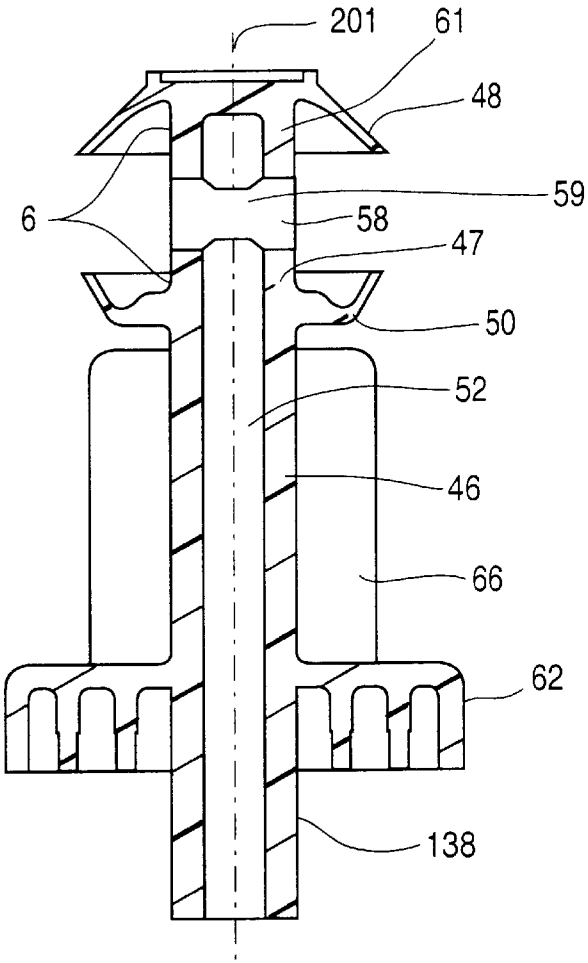
FIG. 4 is a cross-sectional side view along section line 4–4' in FIG. 3.
Figure 3:
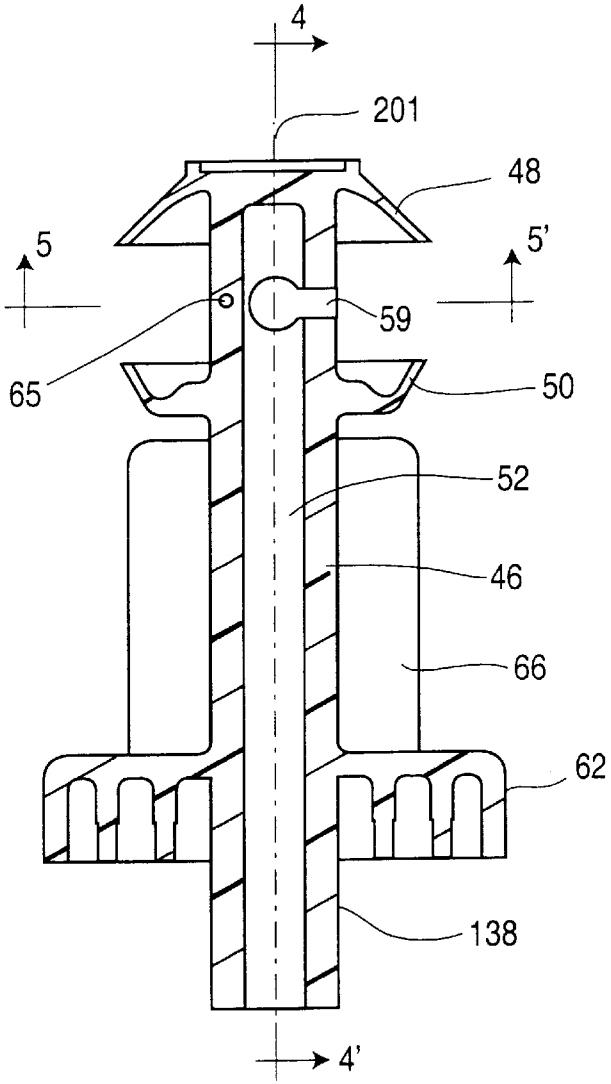
FIG. 3 shows a cross-sectional side view of a piston for a fluid pump having an improved nozzle in accordance with a first embodiment of the present invention.
Figure 5:
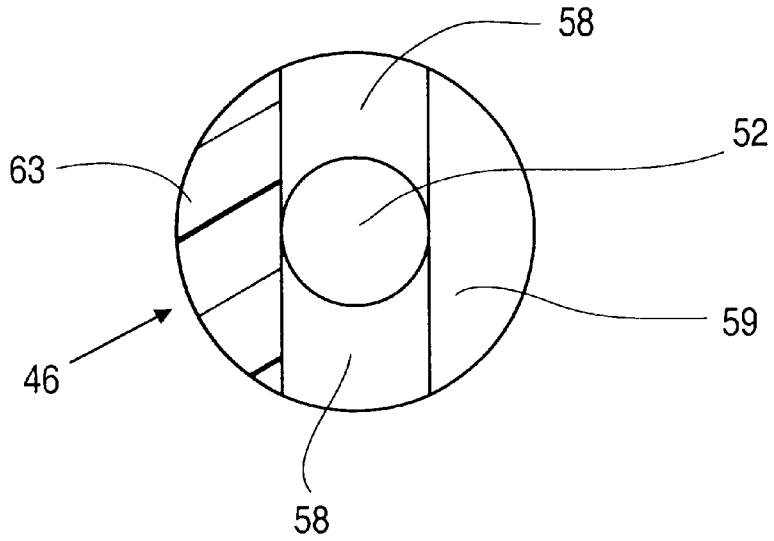
FIG. 5 is a cross-sectional end view along section line 5–5' in FIG. 3.

Reference is particularly made to FIGS. 3 to 6 which illustrate the piston 16 in accordance with the present invention. FIG. 3 shows a cross-sectional side view along a base axis 201. The base axis 201 is defined to be an axis coaxial within the stem 46 outward of the inlet 58. The cross-section of FIG. 3 is normal to the inlet 58. The inlet 58 is shown as a cylindrical bore extending perpendicular to the base axis 201 and normal the plane of cross-section in FIG. 3. The stem 46 has a cylindrical side wall 61 about the central passage 52. As seen in FIG. 3, the cylindrical side wall 61 is effectively removed on one, right-hand side of the inlet 58 such that the slot 59 and inlet 58 together remove the side wall 61 of the stem 46 about the circumference of the side wall 61 to a substantial extent leaving a remaining juncture portion 63 of the side wall opposite the slot 59 and to the left hand side of the inlet 58 as best seen in FIGS. 3 and 5. FIG. 5 is a cross-sectional view along axis 5–5' in FIG. 3 normal the base axis 201 and clearly shows the juncture portion 63.

FIG. 4 is a cross-sectional side view along section line 4–4' in FIG. 3 and shows a view from the inside looking out through the slot 59. Possibly, the configuration of the slot 59 and the juncture portion 63 is best shown in perspective view in FIG. 6 which schematically illustrates a section of the stem 46 between the head disc 48 and the base disc 50. As seen in FIG. 6, the junction portion 63 has an axial extent corresponding roughly to the axial extent of the inlet 58. Inwardly of the junction portion 63, that is, above the junction portion 63 as shown in FIG. 6, there is a head portion 45 of the stem which is fixedly connected to the head disc 48. Outwardly of the junction portion 63, that is, below the junction portion 63 as shown in FIG. 6, there is a base portion 47 of the stem 46.

The head disc 48 and its head stem portion 45 are disposed coaxially about a head axis generally indicated 203 as seen in FIG. 8. The base disc 50 and the base stem portion 47 are disposed coaxially about the base axis 201. The junction portion 63 provides a portion of the stem of reduced cross-sectional area and about which the stem 46 is resiliently flexible as conceptually about a junction axis conceptually indicated as 65 in FIGS. 3 and 6 such that the head disc 48, head portion 45 and the head disc axis may be tilted at an angle relative the base axis 201 and therefore the remainder of the piston 16. The junction portion 63 is resilient and is biased to assume a position as shown in FIGS. 3 to 7 in which the head axis 203 of the head disc 48 is coaxial with the base axis 201.

Reference is made to FIGS. 7 and 8 which show cross-sectional side views of the piston of FIGS. 3 to 6 received within a body 12 identical to that shown in FIGS. 1 and 2.

FIG. 7 illustrates a condition in which the piston 16 is drawn outwardly relative the chamber 18 in the direction indicated by the arrow 220. FIG. 8 illustrates a condition in which the piston is urged inwardly relative the chamber in the direction indicated by the arrow 222.

Referring to FIG. 7, with the piston moving outwardly, the edge portions of the head disc 48 engage the chamber walls 20 to prevent fluid flow inwardly past the head disc 48. In moving the piston 16 outwardly, a vacuum is thereby created inwardly of the head disc 48 whereby fluid is drawn past the one-way valve 14 with deflection of the annular rim 132 of the one-way valve. The engagement of the radially outer edge portions of the head disc 48 with the chamber wall resists movement of the head disc 48 axially outwardly placing the junction portion 63 in tension. The junction portion 63 biases the head disc 48 to assume a position coaxial with the base axis 201. Thus, in the piston moving outwardly during withdrawal, the head disc 48 assumes a sealing condition as shown in FIG. 7. Preferably, the junction portion 63 is configured such that when placed in tension, the junction portion will attend to assume an unbiased position with the head disc 48 and the head axis 203 coaxial with the base axis 201.

FIG. 8 shows a tilted or unsealed orientation the head disc 48 assumes when the piston 16 is moved inwardly into the chamber 18. With inward movement of the piston 16, the one-way valve 14 closes and pressure inwardly of the head disc 48 between the head disc 48 and the one-way valve 14 urges the head disc 48 to deflect in a manner which permits fluid to flow outwardly between the head disc 48 and the chamber wall 20 and, hence, out via the inlet 58 into the passage 52 and out the outlet 54. With inward movement of the piston 16, the flexible junction portion 63 is placed in compression and the head is tilted to the position shown in FIG. 8 with the head axis 203 of the head disc 48 and the head stem 47 tilted relative the remainder of the piston, that is, relative the base axis 201 and, therefore, the central axis of the chamber. As is to be appreciated in both FIGS. 7 and 8, the base axis 201 is maintained coaxially within the chamber 18 as, for example, by reason of the webs 66 being received within the chamber 18.

FIG. 8 illustrates the head axis 203 as being an axis which is coaxial within the head disc 48 and stem head portion 45. The axis 203 is shown to be disposed tilted at an angle to the base axis 201. Preferably, the head disc 48 is adapted to be tilted so that the head axis 203 assumes an angle of at least 5° with the base axis 201. More preferably, the head axis 203 may be adapted to tilt to form an angle of at least 20°, more preferably, at least 30° with the base axis 201.

With the head disc 48 in a tilted configuration as seen in FIG. 8, the resistance to fluid flow past the head disc 48 is reduced. Tilting of the head disc 48 preferably is sufficient that the edge portion of the head disc 48 becomes displaced from the side wall 20 of the chamber 18 over at least one segment about the circumference of the head disc 48. In any event, whether or not the tilting is so substantial that the edge portions of the head disc 48 are disposed radially inwardly from the chamber wall 20 to the extent that at least over some segment the edge portions are moved radially inwardly away from the chamber wall, the extent to which deflection of the edge portion is required to permit fluid flow outwardly therepast is reduced.

Figure 9:
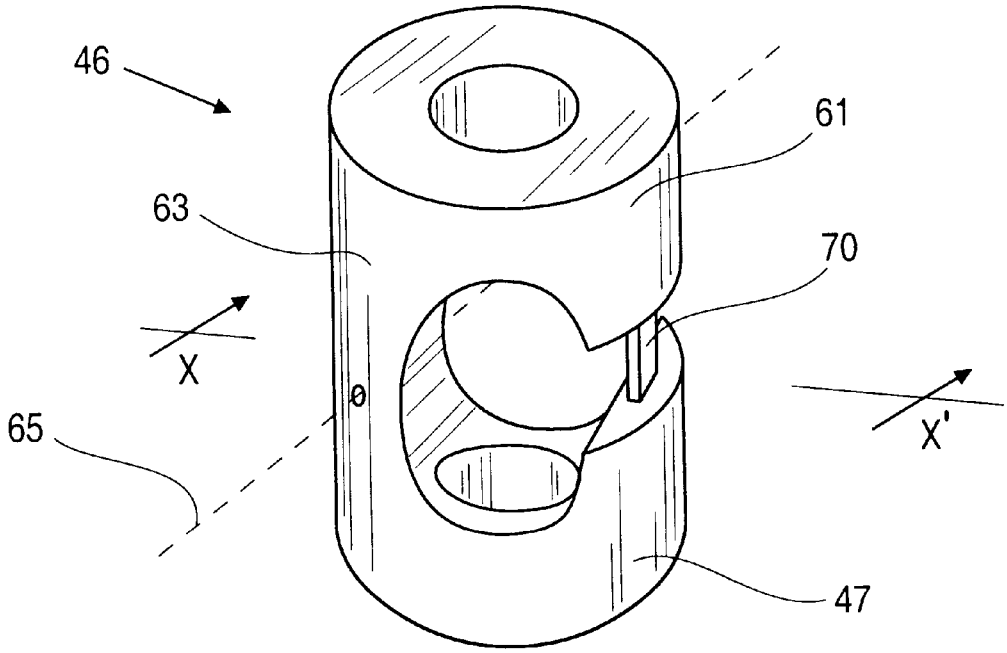
FIG. 9 is a schematic pictorial view of a segment of a stem substantially identical to that of FIG. 6.
Figure 10:
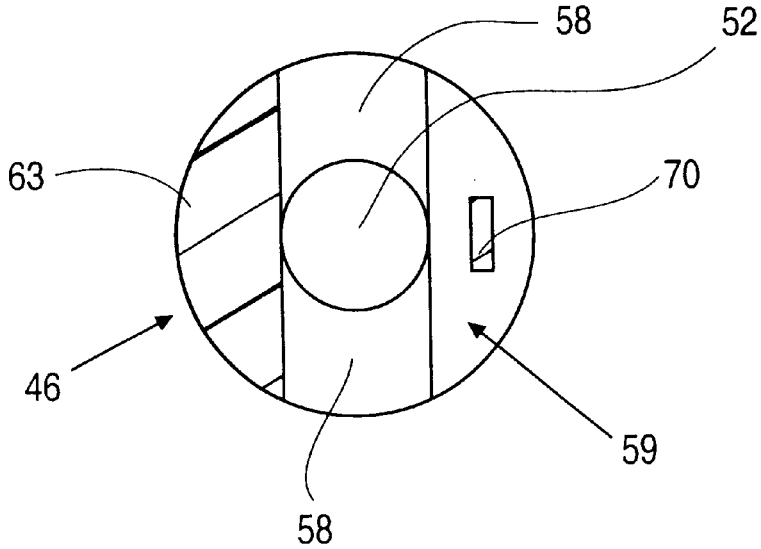
FIG. 10 is a cross-sectional end view along section line X–X' in FIG. 9.
Figure 11:
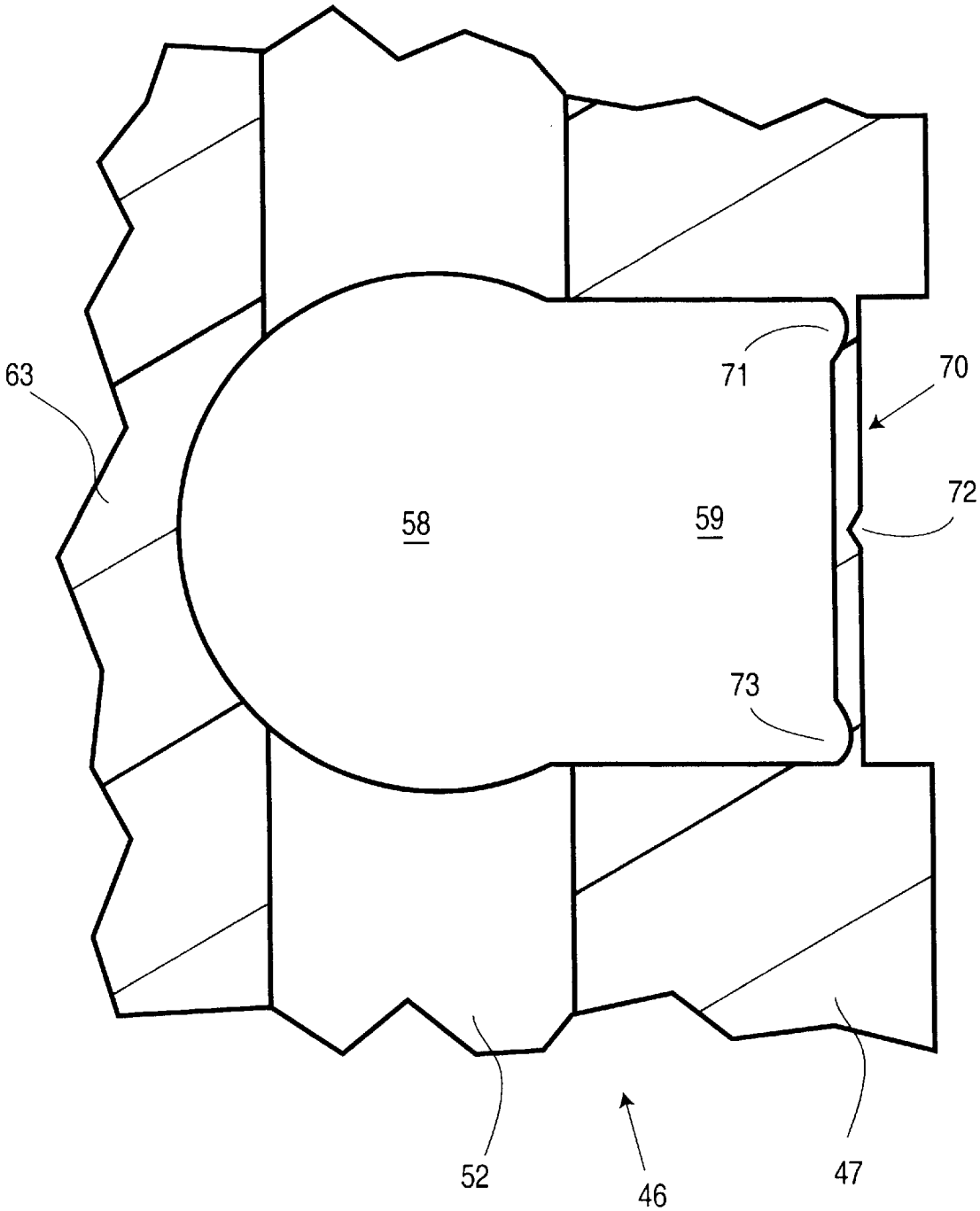
FIG. 11 is a schematic side view of FIG. 9 with the stem in an unbiased or tensioned position.
Figure 12:
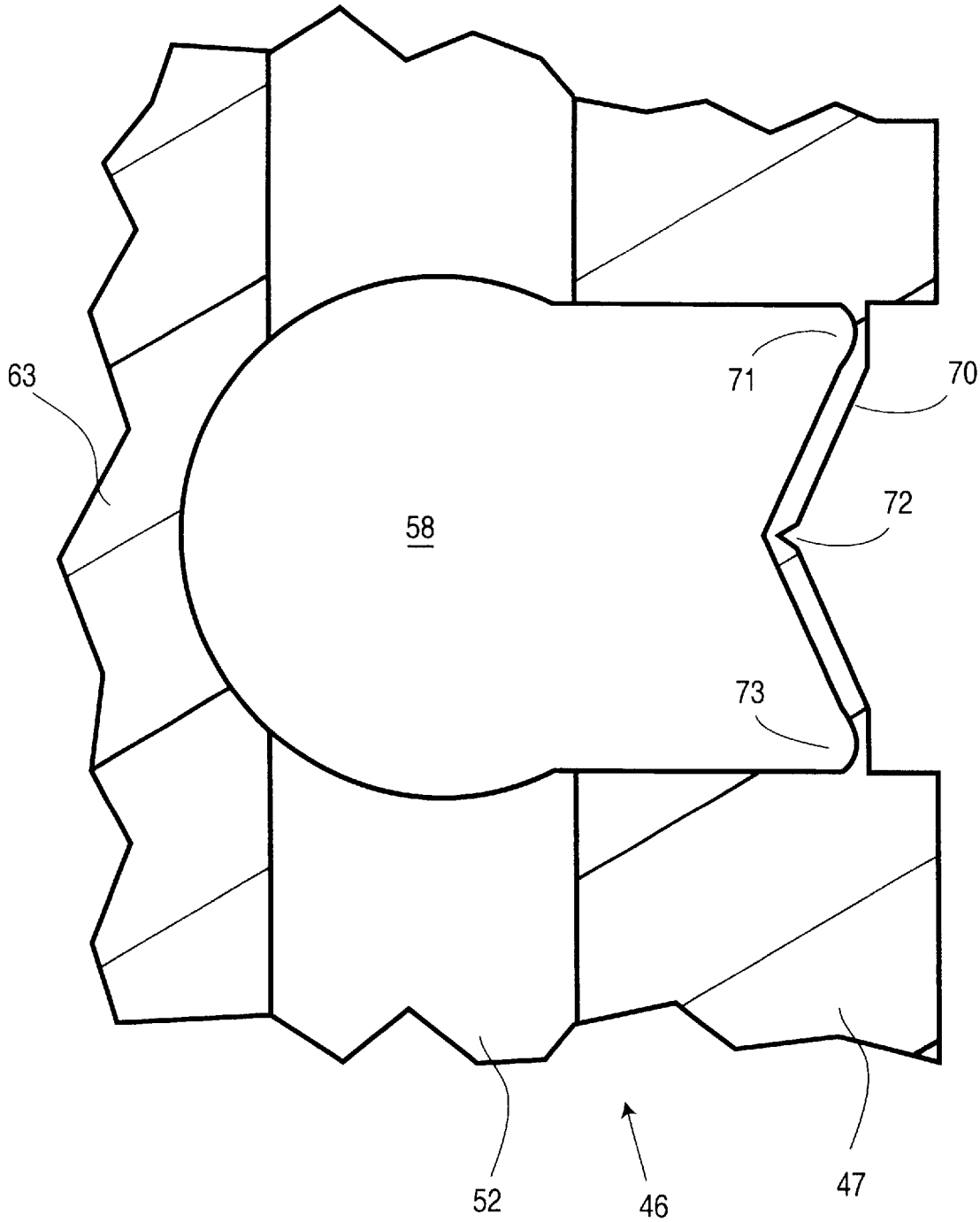
FIG. 12 is a schematic side view similar to FIG. 11 but with the stem in a flexed, bent position.

Reference is made to FIGS. 11 and 12 which show a modification of the stem of the embodiment of FIGS. 3 to 8. FIG. 9 is a view identical to FIG. 6, however, including a strap member 70 bridging the slot 59. The strap member 70 is integrally formed as part of the stem 46. The strap member 70 is a thin member which is adapted to readily bend or fold when placed in compression to permit the junction portion 63 to flex as about junction axis 65 in a direction towards closing the slot 59. The strap member 70, however, prevents the junction portion 63 from flexing in an opposite direction, that is, towards opening the slot 59 beyond a fully open position as shown in FIG. 9.

The strap member 70 may comprise a thin planar member as shown in FIG. 9 which is inherently blendable in compression. FIGS. 11 and 12 are enlarged side views which show the strap member 70 as formed to have living hinge slots 71, 72 and 73 about which the strap member 70 may bend from a fully open position of the slot in FIG. 11 to a position in which the junction portion 63 is fixed and the strap is bent about the hinge slots 71, 72 and 73 as shown.

The strap member need not be planar and could be a flexible string-like member bridging across the slot 59 on the side of the stem 46 opposite from junction portion 63.

In combination, the junction portion 63 and strap 70 when together placed in tension effectively place the head disc into an untilted position, that is, coaxial with the axis of the stem 46. Rather than have a strap member 70, it is to be appreciated that the junction portion 63 could have a configuration to resist bending to open the slot 59 beyond the fully open position in FIG. 6.

In accordance with the preferred embodiment of the invention illustrated, the head disc 48 is illustrated as having elastically deformable edge portions. This is preferred, however, is not essential. The head disc could be a rigid disc sized when coaxial with the chamber 18 to be of substantially the same diameter as that of the chamber 18 and which would provide for fluid flow therepast merely by tilting of the head disc. Preferably, however, fluid is permitted to flow past the head disc 48 by the combination of tilting of the head disc 48 and the radial inward deflection of the edge portion of the head disc.

The preferred embodiment illustrates the piston as being formed from a unitary piece of plastic as by injection molding. It is to be appreciated that a similar structure could be formed from a plurality of elements. The flexible junction portion 63 is shown as being an integral portion of the stem which resiliently flexes. It is to be appreciated, however, that a mechanical hinge construction could be provided to connect the head portion of the stem to the base portion of the stem by a hinge coupling and, preferably, such a coupling could be biased to have the head disc assume a sealed coaxial configuration and resist movement to a tilted unsealed configuration. Preferably, the junction portion which permits tilting of the head disc would limit pivoting at one extreme when the head axis 203 is coaxial with the base axis 201 and at another extreme when the head axis is tilted at an angle to the base axis. Preferably, as seen in the context of FIG. 9, the junction portion 63 would not permit pivoting of the head axis about the junction axis is further counterclockwise as seen in FIG. 7 than the position of FIG. 7 as, for example, is effectively ensured to be accomplished by inclusion of the strap 70.

In accordance with the present invention, the resistance of fluid flow outwardly past the head disc 48 can be reduced as contrasted with that shown in the prior art embodiment in FIGS. 1 and 2 by reason of the tilting of the head disc in addition to the flexing of the perimeter of the head disc. Thus, the force which needs to be applied to the piston to move the piston inwardly to dispense fluid can be reduced. This can be of particular assistance to provide reduced forces required to urge a piston inwardly and thereby make it easier for handicapped persons or persons having less strength to urge the piston inwardly, particularly with relatively viscous fluids.

While the head disc preferably is flexible, in accordance with the present invention, the head disc need not be flexible and, for example, a pump in accordance with the present invention may still function despite the loss of flexibility of the head disc as may occur with time with some plastics.

In the preferred embodiment illustrated, the stem 46 is shown as being a hollow stem with the passageway 52 extending through both the base stem portion and the head stem portion. It is to be appreciated that it is not necessary that the passageway extend into the head stem portion. As well, while the partial removal of the cylindrical side wall of the stem portion provides a convenient mechanism for providing a flexible junction portion of reduced cross-section, many other hinge type arrangements could be structured. In use of such other hinge type structures, it would be acceptable to have the passage 52 end in the base stem portion with the inlets 58 and channel 56 separate from the hinge type structure. For example, the inlets into the passage 52 could be outwardly from any hinge type juncture.

Pumps in accordance with the present invention are particularly adapted to dispense flowable materials including solid particles. The tilting of the head disc with an increased space between the head disc and the side wall of the chamber permits solid particles to more easily flow past the head disc. For example, known flowable hand soaps including pumice and other small diameter solid particles can be readily dispensed with pumps in accordance with the present invention. As well, other flowable slurries and pastes incorporating solid particles in mixture with liquids can be dispensed with these pumps. As well, flowable dry powders as preferably contained in a collapsible container may also be dispensed with a pump in accordance with this invention.

Figure 13:
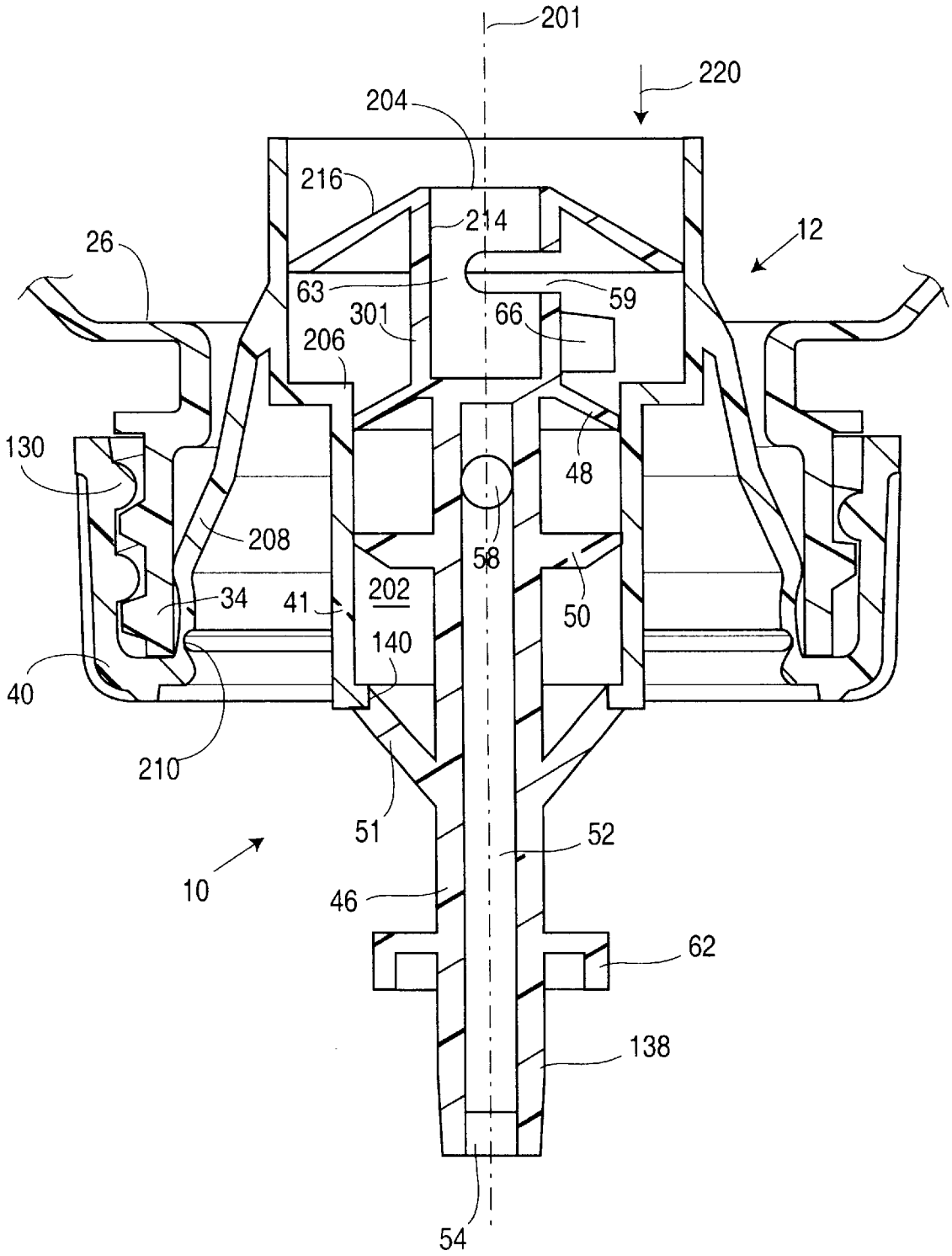
FIG. 13 is a cross-sectional side view of a pump in accordance with a second embodiment of the present invention with the piston being moved in one direction.
Figure 14:
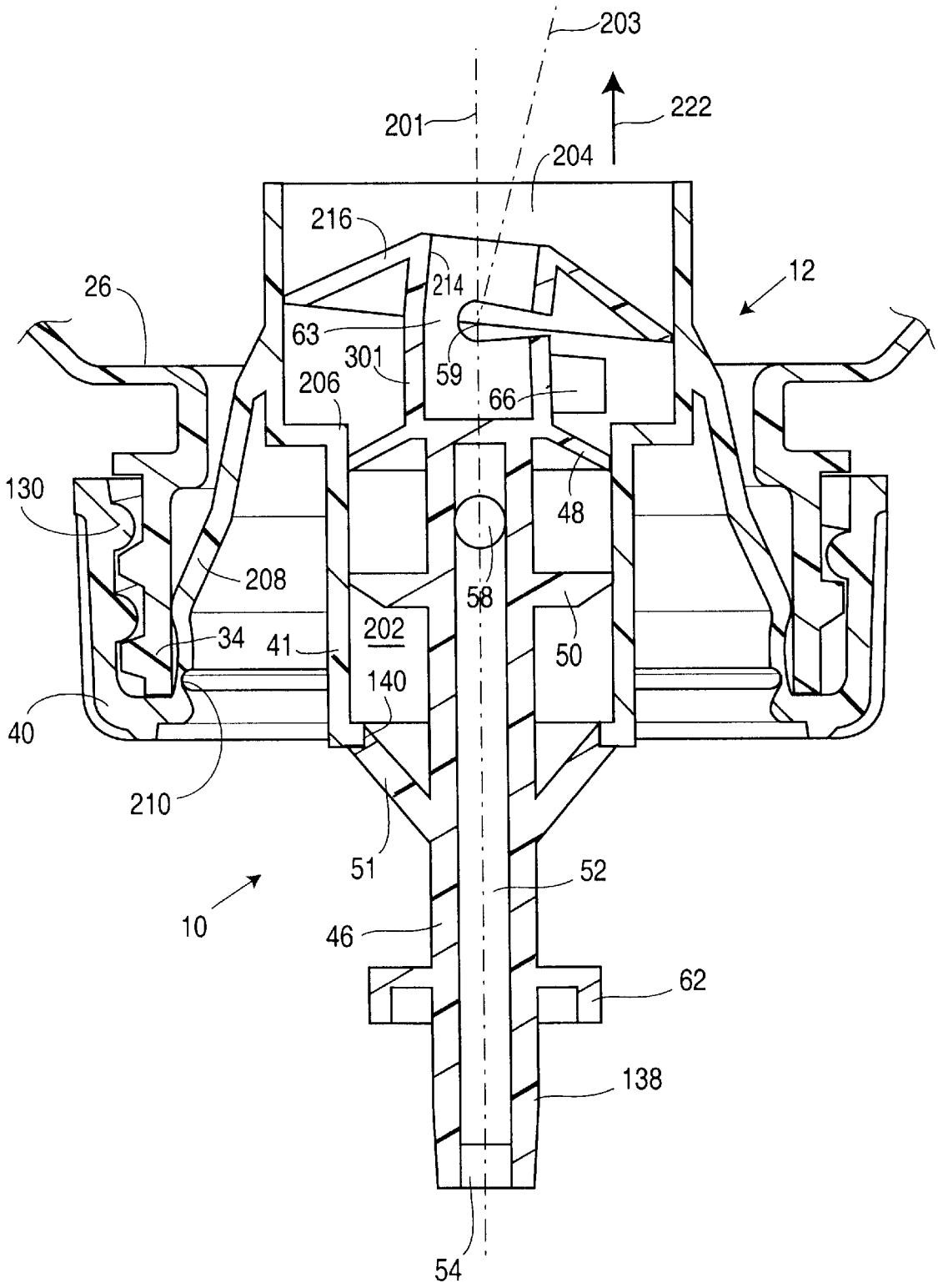
FIG. 14 is a cross-sectional side view similar to FIG. 13 but with the piston being moved in an opposite direction.

The preferred embodiments in FIGS. 3 to 8 illustrate a three-piece pump with the chamber having a chamber of uniform diameter. The invention of the present application is also adaptable for use with pumps having a stepped chamber. Such pumps have been disclosed in US. Pat. No. 5,676,277 to Ophardt, issued Oct. 14, 1997. FIGS. 13 and 14 in this application illustrate a device substantially identical to FIG. 16 of U.S. Pat. No. 5,676,277, however, modified merely so that a cylindrical head portion 301 of the stem has a slot 59 cut through its cylindrical side wall forming a juncture portion 63 of the stem 46 adapted to flex about a juncture axis and permit pivoting of the head axis 203 of the innermost head disc 216 from a coaxial position in FIG. 13 to a tilted position relative the base axis 201 as shown in FIG. 14. In the embodiment illustrated in FIGS. 13 and 14, the innermost flexing disc 216 effectively serves the purpose of a one-way valve and the flexing disc 48 and flexing disc 50 serve the purpose of a similarly numbered disc 48 and 50 in the other embodiments. The webs 66 need not be provided since the discs 48 and 50 and locating discs 51 would assist in ensuring that the base portion of the piston 16 remain coaxially disposed within the chambers. As seen, the chambers comprise an enlarged inner chamber 204 and an enlarged outer chamber 202 coaxial with the inner chamber 204.

While the invention has been described with reference to preferred embodiments, many modifications and variations will now occur to persons skilled in the art. For a definition of the invention, reference is made to the following claims.

I claim:

1. A pump for dispensing fluids comprising:

a piston-chamber forming member having a cylindrical chamber about a chamber axis, the chamber having a cylindrical axially extending chamber wall, a piston forming element received in the piston-chamber forming member axially slidable inwardly and outwardly therein;

said piston forming element having a head disc and a base, the head disc disposed coaxially about a disc axis and extending radially outwardly to a sealing edge portion circumferentially thereabout, the head disc coupled to the base for tilting of the head disc between a first coaxial sealed orientation and a second tilted unsealed orientation, in the first sealed orientation, the head disc is orientated with its axis coaxial the chamber axis and the sealing edge portions engaging the chamber wall to prevent fluid flow therepast in a first direction, in the second unsealed orientation, the head disc is orientated with its axis at an angle relative the chamber axis and the sealing edge portion permitting fluid flow therepast in a second direction opposite to the first direction, the head disc assuming the sealed orientation on relative sliding of the piston forming member in the second direction, and the head disc assuming the unsealed orientation on relative sliding of the piston forming member in the first direction.

2. A pump as claimed in claim 1 wherein the head disc and base are coupled together such that the head disc is biased to assume the sealed orientation.

3. A pump as claimed in claim 2 wherein the sealing edge portion is elastically deformable away from the chamber wall to permit fluid flow in the chamber past the head disc in the second direction.

4. A pump as claimed in claim 3 wherein the head disc having a configuration such that the sealing edge portion extending radially outwardly and axially towards the second direction.

5. A pump as claimed in claim 4 wherein on relative movement of the piston forming element in the second direction, resistance of fluid in the chamber to flow urges the sealing edge portions radially outwardly into sealed engagement with the chamber wall.

6. A pump as claimed in claim 1 wherein the piston forming element having a head portion comprising the head disc, the head portion further including a head stem portion extending axially from the head disc away from the head disc to an end of the head stem portion coupled to the base to permit tilting of the head disc and head stem portion as a unit relative the base between the sealed and unsealed orientations.

7. A pump as claimed in claim 6 wherein the head stem portion is biased to assume the sealed orientation.

8. A pump as claimed in claim 7 wherein the base includes a base stem portion coaxial with the chamber axis, the head stem portion coupled to the base stem, the head stem portion and base stem portion comprising a resiliently deformable integral plastic member with a flexible juncture provided therebetween of reduced cross-section which is resiliently deformable to permit tilting of the head disc portion relative the base stem portion between the unsealed orientation and the sealed orientation.

9. A pump as claimed in claim 8 wherein a base disc is provided on the base stem portion disposed axially about the chamber axis, the base disc having a sealing edge portion circumferentially thereabout extending radially to the chamber wall, the sealing edge portion of the base disc engaging the chamber wall to prevent fluid flow in the chamber past the base disc in the second direction, the base stem portion and head stem portion comprise portions of a hollow tube with a central passageway therethrough closed at an inner end in the head stem portion and open at an outlet proximate an outer end of the piston forming element;

an inlet located on the hollow tube between the base disc and the head disc in communication with the central passageway.

10. A pump as claimed in claim 9 including a junction portion of the hollow tube between the head stem portion and the base stem portion having a slot where a side wall of the tube is removed over a circumferential extent leaving a reduced cross-sectional area of the junction portion on one side which is resiliently deflectable to permit the head stem portion to tilt relative the base stem portion between the unsealed orientation and the sealed orientation.

11. A pump as claimed in claim 10 wherein the slot has a sufficient axially extent to permit the head disc portion to tilt from an orientation in which the axis of the head disc portion is coaxial with the chamber axis to a position in which the axis of the head disc portion is at least at an angle of 5° to the chamber axis.

12. A pump for dispensing fluids from a reservoir, comprising:

(a) a piston-chamber forming element having a cylindrical chamber, said chamber having a chamber wall, an outer open end and an inner end in communication with the reservoir;

(b) a one-way valve between the reservoir and the chamber permitting fluid flow through the inner end of the chamber, only from the reservoir to the chamber;

(c) a piston forming element slidably received in the chamber extending outwardly from the open end thereof;

said piston forming element being generally cylindrical in cross-section with a central axially extending hollow stem having a central passageway open at an outer end forming an outlet and closed at an inner end;

a circular head disc extending radially outwardly from the stem proximate the inner end, the head disc having an edge portion proximate the chamber wall circumferentially thereabout, a circular base disc extending radially outwardly from the stem spaced axially outwardly from the head disc, the base disc having an edge portion proximate the chamber wall circumferentially thereabout, the edge portion of the base disc engaging the chamber wall circumferentially thereabout to form a substantially fluid impermeable seal therewith on sliding of the piston forming element inwardly, an inlet located on the stem between the head disc and the base disc in communication with the passageway via a short channel extending radially inwardly from the inlet to the passageway, locating members on the stem axially outwardly of the head disc extending radially outwardly from the stem to engage the chamber wall and guide the base disc in sliding axially maintaining the base disc centered and coaxially aligned within the chamber, the stem having a resiliently flexible portion intermediate the head disc and the base disc permitting tilting of the head disc relative the base disc between a sealed configuration in which both the base disc and the head disc are coaxial to the chamber axis and an unsealed configuration in which the base disc is coaxial with the chamber axis and the head disc is tilted to an angle to the chamber axis, the flexible portion biasing the stem to assume the sealing configuration, wherein on operation, i) on the piston forming element sliding outwardly in the chamber, the flexible portion assuming the sealed configuration and the edge portion of the head disc engaging the chamber wall to substantially prevent fluid flow past the head disc in an inward direction; and ii) on the piston forming element sliding inwardly in the chamber, fluid flow is permitted past the head disc in an outward direction by the flexible portion being deflected to the unsealed configuration thereby tilting the head disc to an angle to the chamber axis in which at least portions of the edge portion of the head disc are moved radially inwardly away from the chamber wall compared to their position in the sealed configuration.

13. A pump as claimed in claim 12 wherein the locating members comprise a plurality of axially extending webs, and the stem further including engagement members on the stem outward of the chamber forming element for engagement to move the piston forming element inwardly and outwardly.

14. A pump as claimed in claim 12 wherein said flexible portion comprises a portion of said hollow stem having a reduced cross-sectional area.

15. A pump as claimed in claim 14 wherein said flexible portion is formed at a location on the stem where a slot is cut radially into the stem from one side thereof, the slot extending inwardly into communication with the passageway, the slot forming said inlet and the said short channel extending radially inwardly from the inlet to the passageway.

16. A pump as claimed in claim 15 wherein the slot extends a circumferential extent about the hollow stem of at least 180° about the stem.

17. A pump as claimed in claim 12 wherein the edge portion of the head disc is elastically deformable and on the piston forming element sliding inwardly in the chamber, fluid flow is permitted past the head disc in an outward direction by a combination of (a) tilting of the head disc to an angle to the chamber axis and (b) the edge portion of the head disc deforming away from the chamber wall.

18. A pump for dispensing liquid from a reservoir comprising:

a piston-chamber forming member having an inner cylindrical chamber and an outer cylindrical chamber, the inner chamber and outer chamber each having a diameter, a chamber wall, an inner end and an outer end, the diameter of the inner chamber being greater than the diameter of the outer chamber, the inner chamber and outer chamber being coaxial with the outer end of the inner chamber opening into the inner end of the outer chamber, the inner end of the inner chamber in communication with the reservoir, a piston forming element received in the piston-chamber forming member axially slidable inwardly and outwardly therein, said piston forming member being generally cylindrical in cross-section with a central axially extending hollow stem having a central passageway closed at an inner end and having an outlet proximate an outer end, an inner circular flexing disc extending radially outwardly from the stem proximate the inner end, the inner flexing disc having an elastically deformable edge portion proximate the chamber wall of the inner chamber circumferentially thereabout, the outer cylindrical flexing disc extending radially outwardly from the stem spaced axially outwardly from the inner flexing disc, the outer flexing disc having an elastically deformable edge portion proximate the chamber wall of the outer chamber circumferentially thereabout, a circular sealing disc extending radially outwardly from the stem spaced axially outwardly from the outer flexing disc, the sealing disc engaging the chamber wall of the outer chamber circumferentially thereabout to form a substantially fluid impermeable seal therewith on sliding of said piston forming element outwardly, an inlet located on the stem between the outer flexing disc and the sealing disc in communication with the passageway, the piston forming element slidably received in the piston-chamber forming member for reciprocal axial inward and outward movement therein with the inner flexing disc in the inner chamber and the outer flexing disc and sealing disc in the outer chamber, the inner flexing disc substantially preventing fluid flow in the inner chamber past the inner flexing disc in an inward direction, the outer flexing disc substantially preventing fluid flow in the outer chamber past the outer flexing disc in an inward direction, the outer flexing disc elastically deforming away from the chamber wall of the outer chamber to permit fluid flow in the outer chamber past the outer flexing disc in an outward direction, the inner flexing disc elastically deforming away from the chamber wall of the inner chamber to permit fluid flow in the inner chamber past the inner flexing disc in an outward direction, the improvement wherein the stem having an resiliently flexible portion intermediate the inner flexing disc and the outer flexing disc permitting tilting of the inner flexing disc relative a remainder of the piston forming element between a sealed configuration in which the inner flexing disc is coaxial to an axis of the chamber and an unsealed configuration in which the inner flexing disc is tilted at an angle to the chamber axis, the flexible portion biasing the stem to assume the sealing configuration, wherein in operation, i) on the piston forming element sliding outwardly in the chamber, the flexible portion assumes a sealing configuration and the inner flexing disc substantially prevents fluid flow past the flexing disc in an inward direction, and ii) on the piston forming element sliding inwardly into the chamber, fluid flow is permitted past the flexing disc in an outward direction by a combination of the flexible portion being deflected to the unsealed configuration and the flexing disc deforming away from the chamber wall.

* * * * *